United States Patent [19]

Wang

[11] 4,446,812

[45] May 8, 1984

[54] GALVANIZATION INSTALLATIONS OF METALLIC BANDS

[75] Inventor: Robert Wang, Wissous, France

[73] Assignee: Stein Heurtey, Ris-Orangis, France

[21] Appl. No.: 374,262

[22] Filed: May 3, 1982

[30] Foreign Application Priority Data

May 7, 1981 [FR] France ..... 81 09061

[51] Int. Cl.[3] ..... B05C 1/08; B05C 3/172

[52] U.S. Cl. ..... 118/63; 118/419; 118/428; 118/206

[58] Field of Search ..... 118/63, 65, 206, 419, 118/428, 244; 427/428, 434.2

[56] References Cited

U.S. PATENT DOCUMENTS 1,924,142 8/1933 Willauer ..... 118/419 X 3,808,033 4/1974 Mayhew ..... 118/419 X

*Primary Examiner*—John P. McIntosh

*Attorney, Agent, or Firm*—Wenderoth, Lind & Ponack

[57] ABSTRACT

An installation includes a first fixed return roller, positioned above the melted zinc bath level and along which passes the band to be galvanized, when exiting from a galvanization tromp. A second return roller is mounted on a mobile arm and guides the band, after galvanization to an excess metal removing device. A coating roller, mounted on a mobile arm is adapted to be brought to two positions, a first position where it dips into the zinc bath for coating a determined face of the band, and a second position where it is moved clear of the path followed by the band. A bottom roller is supported by a mobile arm so as to be movable to two positions, a working position at the bottom of the tank, so as to provide for the immersion of the band in contact with such roller for carrying out galvanization of both faces, and a rest position clear from the path followed by the band.

5 Claims, 3 Drawing Figures

GALVANIZATION INSTALLATIONS OF METALLIC BANDS

BACKGROUND OF THE INVENTION

1. Technical Field

The subject matter of the invention is improvements in galvanization installations of metallic bands.

2. Background of Prior Art

It is known that in annealing or galvanization lines, a band, after having been subjected to an appropriate annealing cycle, is set in contact with melted zinc for the deposition of such metal on one or two faces. Generally, a galvanization installation comprises: a tank with a bath of melted zinc, one or several return rollers providing the guiding of the band to be galvanized along a path bringing it in contact with the metal of the bath, and means providing for the removal of excess metal and the drying of the band, in order to bring the thickness of the metal deposited to the desired value.

When the installation is provided for the galvanization of both faces of the band, the return roller or rollers are immersed in the tank and preferably positioned at the bottom of the tank so that the band dips into the bath of melted zinc.

For some applications, particularly automobile construction, it is required to provide sheets galvanized on a single face so as to obtain at the same time anti-corrosive properties inside the parts and surfaces solderable on the outer face. In such single face galvanization applications, the return roller or rollers are situated above the zinc bath level and the bath is placed in contact with the face of the sheet to be coated via various means, such as for example a lift due to the meniscus effect, an ebullition or again by using a coating roller partially dipping into the galvanization bath and coating with liquid zinc the required face of the band which is in contact with the bath. In this respect, reference is made to French Pat. No. 7619870 date June 30, 1976.

In consideration of the industrial needs for galvanized sheets, it is desirable to be able to carry out galvanization on one or both faces in the same installation. To this effect, various combinations of mechanical means can be considered, however such solutions require, generally, stopping the installation and changing the equipments, which brings about a significant loss of production capacity.

BRIEF SUMMARY OF THE INVENTION

The object of the present invention is to provide an installation adapted for passing from the galvanization of a metallic band on one face to galvanization on both faces, and vice versa, without having to stop the installation and cut the band. Moreover, the installation according to the invention makes it possible to carry out an annealing operation without galvanization when, for example, the oven connected to the apparatus is used only for annealing purposes.

The installation according to the invention puts into effect the known single face galvanization method, according to which a coating roller is used, which brings melted zinc to the determined face of the band which is stretched horizontally between two return rollers.

Such an installation according to the invention is essentially characterized in that it comprises, in a bell extending into the galvanization bath and connected to a galvanization tromp communicating with an annealing oven:

(a) a first fixed return roller, positioned above the melted zinc bath level and along which passes the band to be galvanized, when exiting from the galvanization tromp, (b) a second return roller, mounted on a mobile arm and providing guiding of the band after galvanization to an excess metal removing means, (c) a coating roller, mounted on a mobile arm and adapted to be brought to two positions: a first position where it dips into the zinc bath for coating a determined face of the band and a second position where it is moved clear of the path followed by the band, and (d) a bottom roller supported by a mobile arm so as to be movable to two positions: a working position at the bottom of the tank so as to provide for immersion of the band in contact with such roller for carrying out galvanization of both faces, and a rest position clear from the path followed by the band.

According to a feature of this invention, the bottom roller is mounted at the end of an arm sliding in a stationary portion of the installation, and the arm supporting the coating roller is articulated on an axis provided on such stationary portion.

According to another feature of this invention, the installation comprises moreover a correcting roller, placed below the melted zinc bath surface, for improving the flatness of the band when the excess metal is being removed, where galvanization on both faces is involved, such correcting roller being mounted on a mobile arm.

According still to another feature of this invention, the installation comprises two mobile blowing nozzles for removing the excess zinc deposited during the coating of the band on one or both faces thereof.

Further characteristics and advantages of this invention will become more apparent upon making reference to the description to follow and the accompanying drawings showing an embodiment thereof, without being limited thereto.

DETAILED DESCRIPTION OF INVENTION

Figure 1:
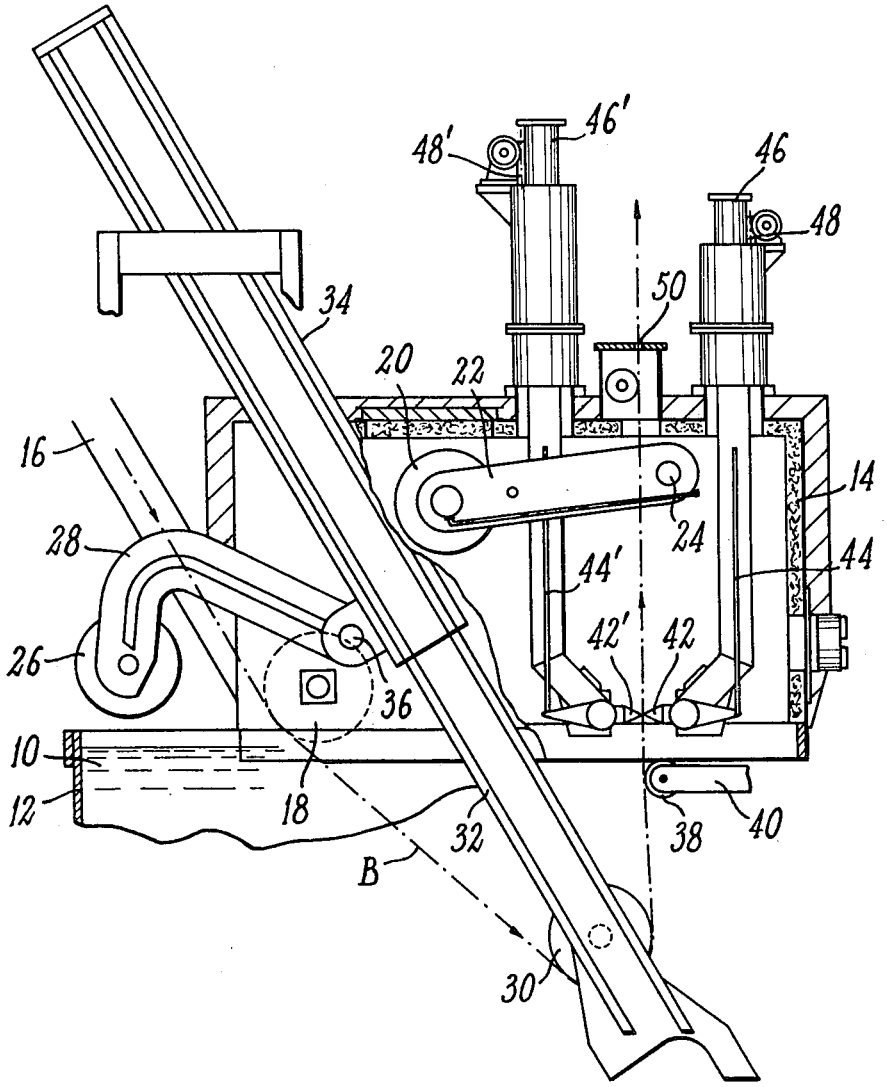
FIG. 1 is a side elevation view, partially broken away, of an installation according to the invention, including mobile rollers being positioned so as to carry out a galvanization on both faces of a band.
Figure 2:
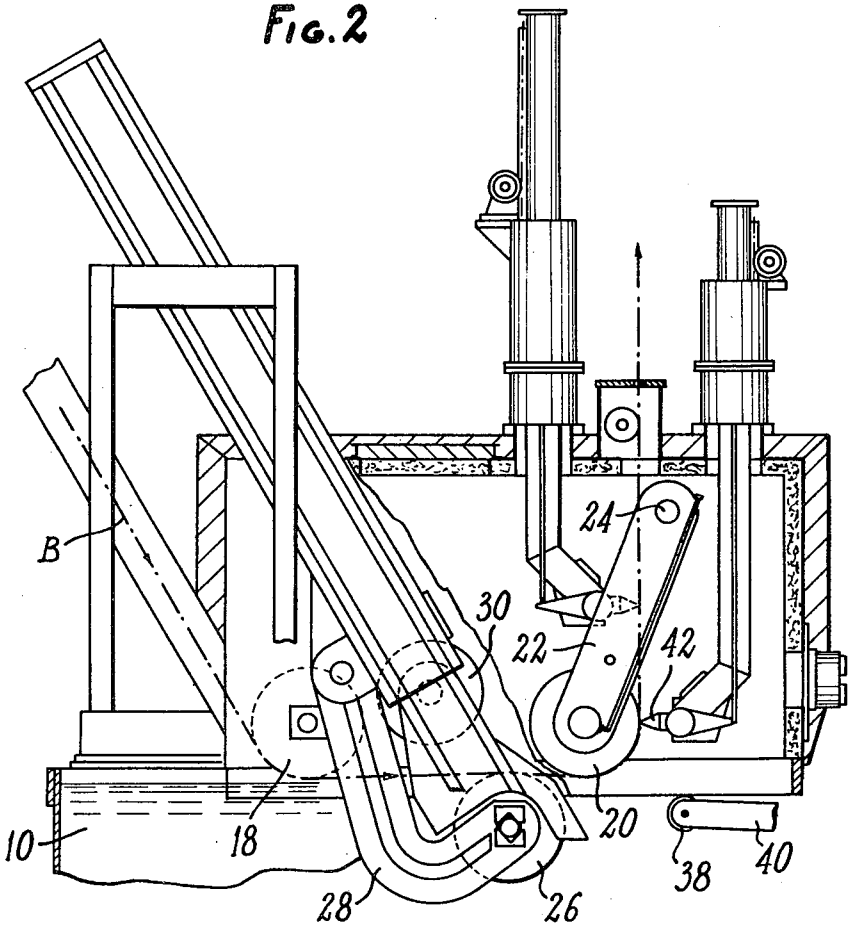
FIG. 2 is a view similar to FIG. 1, showing the position of the mobile rollers for a single face galvanization.

Reference is made to the drawings and more particularly to FIGS. 1 and 2.

The invention comprises, as is known, a molten zinc bath 10 contained in a galvanization tank 12, heated by any appropriate means, a bell 14 extending into the galvanization bath 10 and a galvanization tromp 16 connected to the bell 14 and communicating with an annealing oven, not shown.

According to the invention, the metallic band B, which is to be galvanized on one or both faces, passes first along a fixed return roller 18, mounted in the bell 14, above the melted zinc bath 10 and at the opening of the tromp 16 in the bell. The installation comprises a second return roller 20, journaled at the end of an arm 22 articulated at 24 to the bell walls so as to be adapted to assume two positions, i.e. a rest position (FIG. 1) where it is kept clear from the path followed by the band B, and a working position when the band B comes to bear against roller 20 (FIGS. 2 and 3) in order to stretch the band horizontally between the return rollers 18 and 20.

A coating roller 26 is journaled at the end of an articulated arm 28. It can assume therefore two positions, i.e. a rest position where it is clear from the path follower by band B (FIGS. 1 and 3), and a working position (FIG. 2) where it ensures, as will appear clearly hereafter, the coating of the band face bearing on it.

The installation comprises still a fourth roller, called bottom roller 30, journaled at the end of a mobile arm 32. In the embodiment shown in the drawings, the arm 32 slides inside a stationary element 34 fixedly connected to bell 14, and the arm 28 receiving the coating roller 26 is articulated at 36 to the stationary element 34.

Therefore, the bottom roller 30 can assume two positions, i.e. a working position (FIG. 1) where it dips into the galvanization bath 10 while supporting the band, and a rest position (FIGS. 2 and 3) where it is retracted clear from the path followed by the band.

Moreover, the installation comprises a correcting roller 38 mounted at the end of a mobile arm 40. The roller 38 is placed below the surface of the galvanization bath 10 in order to improve the flatness of the band when being dryed when a two face galvanization operation is involved. Finally, the installation is provided, as is known, with metal removing means for bringing the thickness of the deposited metal to the desired value. Such means consist here of blowing nozzles 42, 42' mounted at the end of articulated arms 44, 44' making it possible to modify the orientation of the gaseous stream distributed by each nozzle. Each of the nozzles and articulated arms are mounted on a tube 46, 46' respectively, which is movable vertically via a rack system 48, 48' respectively.

The control systems of the displacements of the various mobile rollers are situated outside and provided in a standard manner. For this reason, they are not described here.

The various modes of operation of the installation thus described are the following:

1 Two face galvanization (FIG. 1)

The coating roller 26 and the mobile return roller 20 are both in the respective rest positions and the bottom roller 30 is in a working position, i.e. at the bottom of the galvanization tank 12. The band B passes therefore along the first fixed return roller 18, dips into the melted zinc bath 10, passes around the bottom roller 30 and exits from the bath by bearing on the correcting roller 38 in order to pass between two blowing nozzles 42, 42' placed opposite each other, the nozzles eliminating excess zinc carried by the band when exiting from bath 10.

2 Single face galvanization (FIG. 2)

The bottom roller 30 is in a rest position, above the bath surface 10, away from the path followed by the band. The coating and return rollers, 26 and 20 are in the respective working positions, and the correcting roller 38 is retracted. The band B is engaged therefore along the first return roller 18, passes along the coating roller 26 which partly dips into the bath 10, then around the second roller 20, while being stretched horizontally between the two return rollers 20 and 18. The second coating roller 26 deposits, as is known, a layer of liquid zinc on the lower face of the band. After passing around roller 20, the band moves past the blowing nozzle 42 which eliminates excess zinc deposited on the lower face of the band during coating by roller 26. The second nozzle 42' does not operate.

Figure 3:
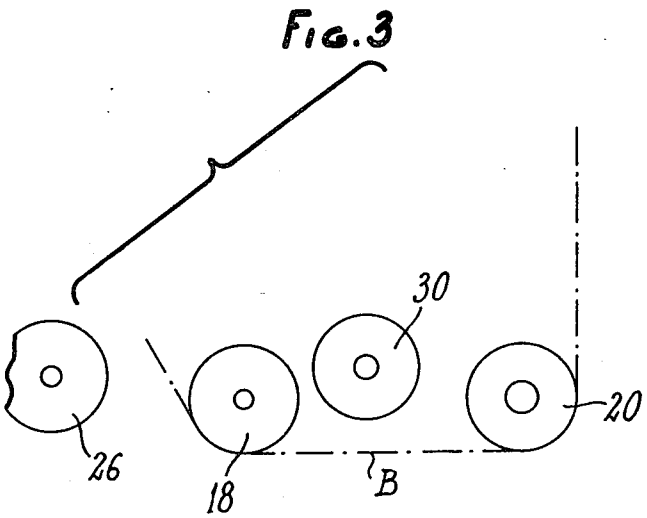
FIG. 3 is a very schematic view showing the position of the various rollers of the devices used for an annealing operation without galvanization.

3 Annealing without galvanization (FIG. 3)

In this mode of operation shown schematically in FIG. 3 by the position of the various rollers, the return rollers 18 and 20 are in a working positions and the coating and bottom rollers 26 and 30 are in the respective rest positions, clear from the path followed by the band. There is no contact between the melted zinc of bath 10 and band B, and the excess metal removing operation is not operating.

In all these modes of operation, the atmosphere under bell 14 is composed of a nitrogen/hydrogen mixture comprising preferably from 2 to 5% hydrogen. The pressure within the bell is kept positive relative to the ambient conditions by a bleed formed across a slit 50 through which passes the band, eventually completed by a sealing device placed where the band exits into the ambient air.

It is clear from the above description that the invention provides an installation which, by simply positioning various rollers on which bears the band, and without stopping the installation, nor cutting the band, makes it possible to obtain three distinct modes of operation, which is not possible with the hitherto existing installations.

The present invention is of course not limited to the embodiment described and shown, and it encompasses all alternatives thereto.

What I claim is:

1. An installation for galvanizing a metal band on one or both sides thereof, said installation comprising:

a tank containing a molten zinc bath and through which a metal band to be coated is passed continuously;

means for causing said band selectively to pass along a first path and for galvanizing both sides of said band or along a second path and for galvanizing one side only of said band, said means comprising:

a fixed first return roller positioned above the upper surface of said bath at a location to be contacted by a first side of said band during passage thereof along either said first or second paths;

a second return roller mounted on a first mobile arm for movement between a rest position out of contact with said band during passage thereof along said first path and a working position in contact with said first side of said band during passage thereof along said second path;

a coating roller mounted on a second mobile arm for movement between a rest position out of contact with said band during passage thereof along said first path and a working position partially immersed in said bath and in contact with a second side of said band during passage thereof between said first and second return rollers along said second path, thereby coating said one face of said band with said molten zinc; and a bottom roller mounted on a third mobile arm for movement between a working position immersed in said bath and in contact with said first side of said band and causing said band to pass into and from said bath during passage thereof along said first path, whereby both sides of said band are coated with said molten zinc, and a rest position out of contact with said band during passage thereof along said second path; and means for removing excess molten zinc from said band after passage thereof through either said first or second paths thereof.

2. An installation as claimed in claim 1, wherein said third mobile arm is mounted for longitudinal sliding movement with respect to a stationary member, and said second mobile arm is mounted on said stationary member for pivotal movement about an axis.

3. An installation as claimed in claim 1, further comprising a correcting roller mounted below said upper surface of said bath for contacting said band to improve the flatness thereof during passage of said band from said bottom roller to said removing means along said first path.

4. An installation as claimed in claim 3, wherein said correction roller is mounted on a fourth mobile arm.

5. An installation as claimed in claim 1, wherein said removing means comprise two separately movable blowing nozzles for directing fluid jets against respective sides of said band after coating thereof.

* * * * *